US010054345B2

(12) United States Patent
Cantadori

(10) Patent No.: US 10,054,345 B2
(45) Date of Patent: Aug. 21, 2018

(54) METHOD FOR TRANSFERRING COOLANT FROM A LOADING UNIT TO AN AIR CONDITIONING SYSTEM

(71) Applicant: BRAIN BEE S.P.A., Parma (PR) (IT)

(72) Inventor: Andrea Cantadori, Parma (IT)

(73) Assignee: MAHLE AFTERMARKET ITALY S.P.A., Parma (IT)

( * ) Notice: Subject to any disclaimer, the term of this patent is extended or adjusted under 35 U.S.C. 154(b) by 13 days.

(21) Appl. No.: 14/811,060

(22) Filed: Jul. 28, 2015

(65) Prior Publication Data

US 2017/0030617 A1 Feb. 2, 2017

(51) Int. Cl.
*F25B 45/00* (2006.01)

(52) U.S. Cl.
CPC ..... *F25B 45/00* (2013.01); *F25B 2345/001* (2013.01); *F25B 2345/003* (2013.01); *F25B 2345/007* (2013.01)

(58) Field of Classification Search
CPC ..... F25B 2345/007; F25B 2345/003; F25B 2345/001; B60H 1/00899; B60H 1/323; B60H 1/00007; B60H 1/00914; B60H 1/00392; B60H 1/00278; B60H 1/00885; B60H 1/3222
See application file for complete search history.

(56) References Cited

U.S. PATENT DOCUMENTS 4,982,576 A * 1/1991 Proctor ..... B60H 1/00585 62/195
5,758,506 A * 6/1998 Hancock ..... B60H 1/00585 62/149
2003/0196450 A1 10/2003 Higami
2013/0205811 A1* 8/2013 Esch ..... B60H 1/00585 62/77

FOREIGN PATENT DOCUMENTS

CN 103143539 A 6/2013
EP 2363669 A2 9/2011
WO 2010032107 A2 3/2010

OTHER PUBLICATIONS

Applicant Admitted Prior Art as per instant specification Drawing 1.*
Applicant Admitted Prior Art as per instant specification Drawing 1, Jul. 28, 2015.

* cited by examiner

*Primary Examiner* — Emmanuel Duke
(74) *Attorney, Agent, or Firm* — Pearne & Gordon LLP

(57) ABSTRACT

Method for transferring coolant fluid from a loading unit/station to an air conditioning system, via at least one high pressure HP valve and duct, for the introduction of liquid coolant, and at least one low pressure LP valve and duct, for the suction and the recovery of the coolant-vapor in the system. It is provided for executing the step of transferring the fluid also maintaining the low pressure circuit branch open/active, through relative LP valve. Part of the coolant loaded during the transfer step passes through a valve for the expansion of the system and it is suctioned, as vapor, by the station through LP: the net amount that enters into the system is always positive given that there is more loaded coolant with respect to the suctioned coolant.

8 Claims, 2 Drawing Sheets

METHOD FOR TRANSFERRING COOLANT FROM A LOADING UNIT TO AN AIR CONDITIONING SYSTEM

FIELD OF APPLICATION OF THE INVENTION

The present invention regards a method of maintenance of an air conditioning system and a connection device for the use of the latter. In particular, the present invention finds application in the automobile industry, for example in vehicle repair workshops.

PRIOR ART

The air conditioning systems are subject to leakage of coolant fluid and require periodic reloading. Thus, there arises the need to actuate a cycle for reloading and/or regenerating the system; for this purpose, there were developed devices for the maintenance of air conditioning systems capable of executing the recovery, the recirculation and reloading of the coolant fluid in the system.

TECHNICAL BACKGROUND

An air conditioning system is a closed system, which operates on pressure difference and change of state that the coolant gas is subjected to throughout the circuit. The components in question are:

- the compressor suctions and compresses the coolant, modifying its state and the temperature (from low pressure and low temperature to high pressure and high temperature); it has the function of compressing the coolant gas, making it pass from low temperature and low pressure to high temperature and high pressure. It is a precision component, whose quality has a major impact in terms of safety, comfort and energy saving. The compressor contains rotary parts, and thus should be suitably lubricated with a specific oil, with characteristics suitable for the refrigerating circuit;
- the condenser transfers heat to the external air and condenses the coolant, which thus passes from the gaseous state to the liquid state; in practice, it is a heat exchanger which serves to cool and thus liquefy the coolant gas coming from the compressor; it is mainly formed by ducts (primary exchange surface) and fins (secondary exchange surface). Usually, in vehicles it is positioned in the front part, before or beside the engine radiator. It transfers heat to the environment, given that its temperature is higher with respect to the one surrounding it. The air passes through the fin elements of the condenser and, by subtracting heat, it causes the liquefying of the refrigerating fluid or coolant;
- the coolant traverses the de-hydrating filter, which absorbs moisture and withholds impurities (the de-hydrating filter is placed between the condenser and the expansion valve and it is traversed by coolant in high pressure liquid state); the coolant then reaches the expansion valve, where it is subjected to a drastic pressure and temperature drop;
- in the evaporator, the coolant once again changes its state, passing from liquid to gaseous. It absorbs heat and lowers the temperature of the air introduced into the cabin through the aeration ducts; the evaporator is also a heat exchanger. It is conceptually identical to the condenser though having the opposite function. Inside, the coolant passes from the liquid state to the gaseous state absorbing heat from the environment. The air which traverses the fins thereof is cooled and enters into the cabin through the aeration ducts.

GENERAL OPERATION

During the step of recovery and recirculation, the coolant fluid is taken from the air conditioning system through a rapid connection system connected to a recovery duct. Subsequently, the fluid is purified and accumulated in a deposit tank.

During the reloading step, a vacuum pump arranged downstream of the deposit tank creates a depression which moves the coolant fluid from the tank to the air conditioning system.

There can be provided for methods for measuring the mass associated to the tank, so as to monitor both the amount of re-circulated coolant fluid and the amount subsequently injected in the air conditioning system.

In any case, the coolant fluid is subsequently injected in the air conditioning system, generally passing through a quick connection interposed between the loading duct and the coupling on the vehicle side.

DESCRIPTION AND ADVANTAGES OF THE INVENTION

An object of the present invention is to provide a method for transferring coolant fluid from a loading unit or station to an air conditioning system, providing for performing the transfer or loading of the coolant maintaining both high pressure and low pressure branches active, the latter usually dedicated to the recovery of coolant-vapour during emptying of the system.

Advantages

- it guarantees the completion of the loading in any situation
- it eliminates the so-called heating bundle used for supporting the coolant tank, and the duration of the vacuum phase (during which the bundle is activated) is no longer significant
- it avoids having to utilize the overheating of the cylinder which facilitates the loading but slows the subsequent recovery,
- it offers performance comparable to a good liquid pump (1000 g/min averagely).

In addition, with a suitable choice of times and regulations of the reloading station, as well as the capacity (flow rate) of the station compressor, it is also possible to reload without performing vacuum phase, though minimum, and even reload the systems already partly loaded with coolant.

Said objects and advantages are attained by the method for transferring the coolant from a loading unit to an air conditioning system, subject of the present invention, which is characterized by what is provided for in the claims below.

BRIEF DESCRIPTION OF THE DRAWINGS

This and other characteristics shall be more apparent from the following description of some embodiments illustrated, purely by way of non-limiting example, in the attached drawings.

DESCRIPTION OF THE INVENTION

Figure 1:
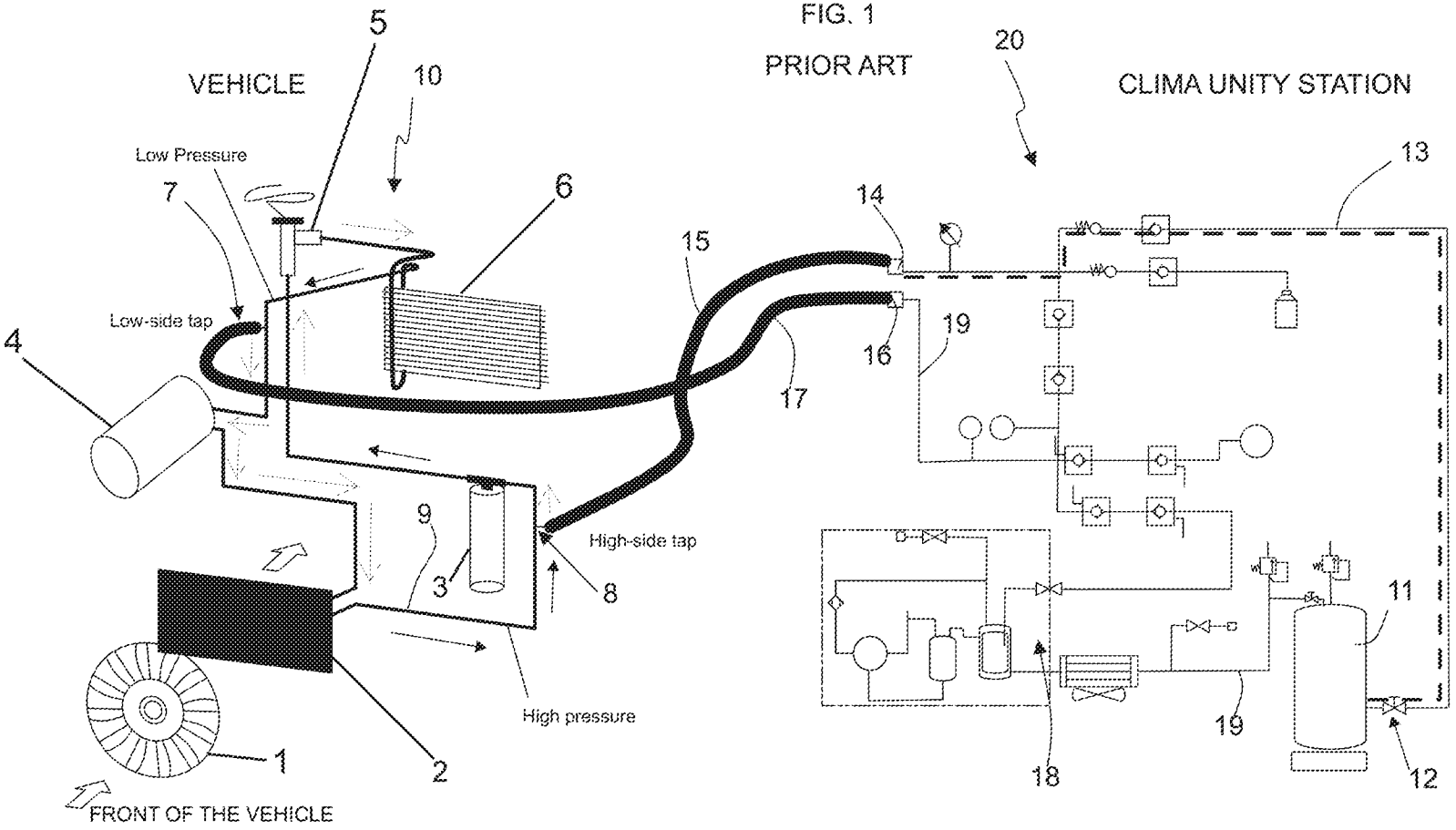
FIG. 1 PRIOR ART
FIG. 1: illustrates the operating principle of the method for loading the coolant from the station to the vehicle, of the known type.

With particular reference to FIG. 1 there is indicated a method for transferring the coolant fluid, of the known type.

For example, reference is made to an automobile vehicle system.

Usually, the method can be actuated after the connection of the air conditioning system to be loaded, in the example indicated in its entirety with reference 10, with at least one unit 20 for the recovery and/or reload of coolant fluid, generally known as "air conditioning station".

The air conditioning system, which substantially performs a refrigerating cycle, is indicated with:

a compressor 4;

a condenser 2 and ventilation system 1;

at least one de-hydrator filter 3, an expansion valve 5;

an evaporator 6.

The components described above are connected by a closed circuit schematically illustrated by lines 9; there is also present a low pressure (LP) point of drawing 7 and a point of introduction 8 on the high pressure HP branch; the latter two allow the coupling with corresponding connection devices of an air conditioning station, as described hereinafter, with the aim of performing the maintenance, reload operations, etc. . . . .

The air conditioning station, 20, comprises therein:

a coolant tank 11, or cylinder a cut off valve 12 for opening and closing at least one duct 13 for the exit of coolant fluid, said duct 13 reaches, through known suitable systems, a HP connection, i.e. at high pressure, indicated with 14 connectable in the relative high pressure HP branch 15 to the air conditioning system 10, so as to be connected with the high pressure liquid coolant, or fitting/valve 8;

there is also present an LP connection, i.e. with low pressure, which can be identified with 16, and which can be connected through the relative branch 17 to the air conditioning system, in the fitting indicated with 7 generally arranged after the expansion valve 5; the coolant is in the gaseous state and with low pressure;

A suctioning group 18 which, through special compressor means, draws/extracts the coolant from the air conditioning system of the vehicle, through the low pressure branch 17, and takes it into the tank 11, by means of ducts 19, so as to empty the system.

Thus, it is usually provided for drawing/recovering the coolant through the branch 17 connected to the low pressure valve, indicated with LP, and reloading, i.e. sending the new coolant, the system through the duct 15 of the valve HP.

In practice the method of maintenance of an air conditioning system, comprises the steps of:

recovery of the coolant fluid present in the air conditioning system, on the LP valve side;

filtering of the recovered coolant fluid;

injection of coolant fluid in the air conditioning system, on the HP valve side;

By implementing the conventional loading method, i.e. from the air conditioning station to the vehicle, the coolant is transferred passing it from the tank to the system through the HP path, as indicated in FIG. 1.

Figure 2:
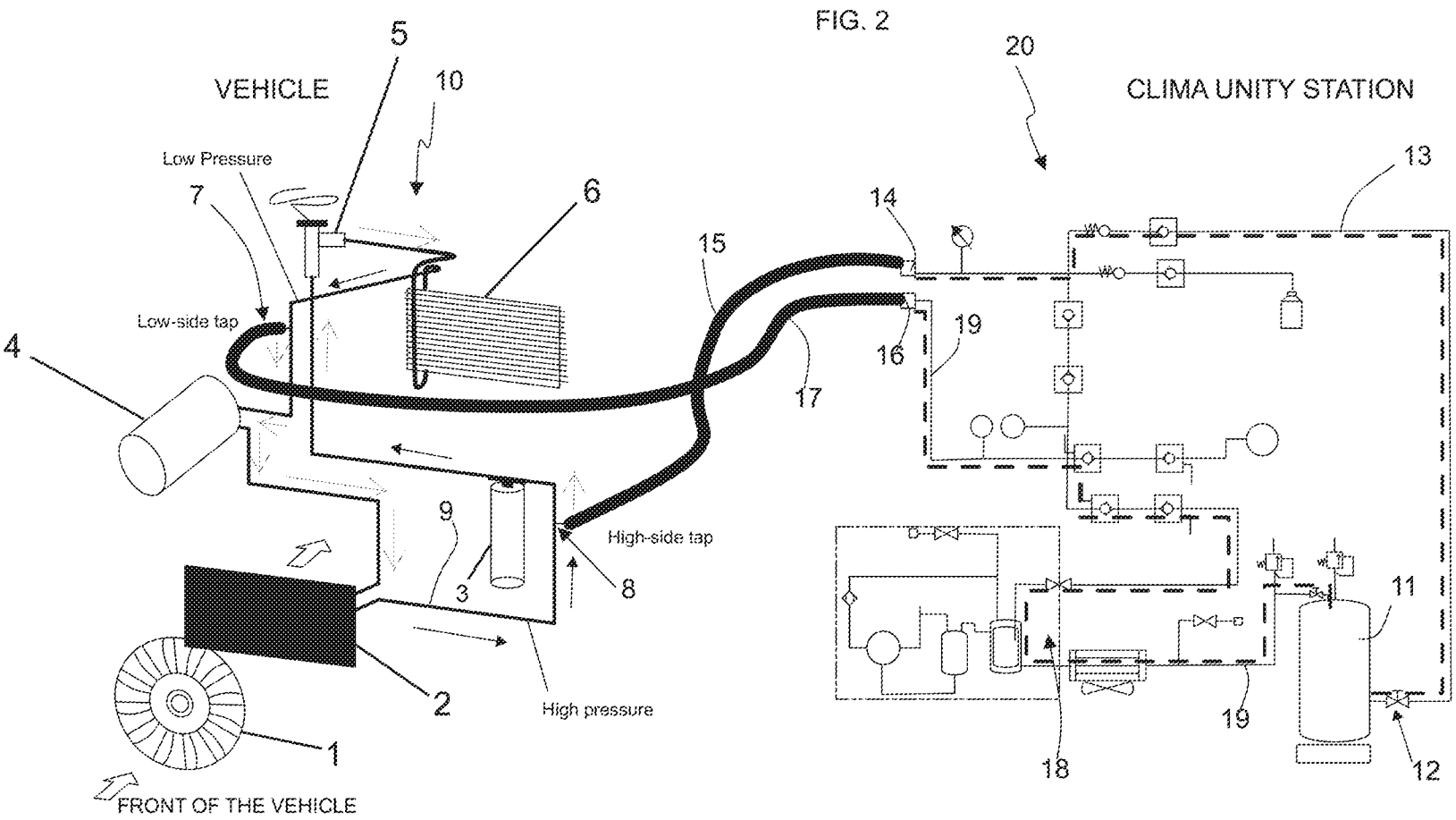
FIG. 2: illustrates the operating principle of the method for loading coolant from the station to the vehicle, subject of the present invention.

The method for transferring coolant from the unit 20 to the system 10, subject of the present invention, provides for transferring the fluid from the tank 11 through the duct 13, 15 entering in 8 in the system 10; in addition, it also provides for that the recovery circuit remains active, i.e. open, during said transfer, as illustrated in FIG. 2, identified by the drawing point 7, duct 17 and branch 19 thus allowing the passage of fluid in the circuit through the air conditioning station.

Thus, the low pressure circuit (vehicle side) has a lower pressure than that it would have with a conventional loading: the loaded coolant passes through the valve for the expansion of the system but, given that the LP circuit is open, part of the loaded coolant is constantly suctioned (it is a vapour) by the station through the LP valve and line.

The compressor of the station, recovering the coolant from LP and pushing it into the cylinder, contributes to keeping loading pressure high.

As mentioned previously:

vapour is recovered from the LP line liquid is loaded from the HP line

Thus, the net amount that enters into the system is always positive, i.e. there is more loaded coolant with respect to the suctioned coolant.

Below is a summary of the advantages that can be obtained with the described and claimed loading method:

The loading occurs at speeds comparable with those that can be obtained with a loading gear pump, The loading is always completed automatically, even when the station is used for loading a system with brief vacuum phase, The recovery from the branch of the low pressure LP valve cools the system, thus further facilitating the loading.

With suitable choice of the times and adjustment of the loading station, as well as the capacity (flow rate) of the compressor of the station, it loads without performing any vacuum phase, though minimum, and reloads systems already partly full of coolant.

The method for transferring coolant fluid from a thank (11) of a loading unit/station (20) to an air conditioning system (10), said air conditioning station (20) comprising:

a. a coolant tank (11), b. a cut off valve (12) for opening and closing at least one duct (13) for the exit of coolant fluid, c. an HP high pressure connection (14) connectable in the relative high pressure HP branch (15) to the air conditioning system (10), so as to be connected with the high pressure liquid coolant, or fitting/valve (8);

d. an LP low pressure connection (16) and which can be connected through the relative branch (17) to the air conditioning system (10), by means of a fitting/valve (7), arranged after the expansion valve (5) of the air conditioning system (10);

e. a suctioning group (18) which, through compressor means, draws/extracts the coolant from the air conditioning system (10), through the low pressure branch (17), and takes it into the tank (11), by means of ducts (19), so as to empty the system;

wherein for executing the step of transferring the fluid also maintaining the low pressure circuit branch (17) open/active, through relative low pressure LP valve; the activation/opening of the low pressure LP branch which connects the air conditioning station to the LP valve of the air conditioning system, occurs at least partly simultaneously with the activation/opening of the high pressure HP branch which connects the air conditioning station to the HP valve of the air conditioning system.

The part of the coolant loaded during said transfer step passes through the valve (5) for the expansion of the system and it is suctioned, as vapour, by the station through LP so that the net amount that enters into the system is always positive and there is more loaded coolant with respect to the suctioned coolant. Typically the internal volume range of an air conditioning system 10 of a vehicle is around 1.5 and 2 liters, and requires 400-900 grams of coolant. The expansion valve 5 generates on the LP low pressure branch a pressure of 2-3 bar. For providing the claimed method the compressor of the suctioning group 18 must generates a flow of 25-60 liters per minute.

The invention claimed is:

1. A method for loading coolant fluid from a loading unit/station to an air conditioning system of a vehicle, the method utilizing an air conditioning station which comprises:

a. a coolant tank, b. a cut off valve for opening and closing at least one duct for the exit of coolant fluid, c. a high pressure connection connectable in a respective high pressure branch to the air conditioning system so as to be connected with high pressure liquid coolant fluid, d. a low pressure connection connectable through a low pressure branch to the air conditioning system through a fitting arranged after an expansion valve of the air conditioning system, and e. a suctioning group which, through a compressor, draws/extracts the coolant fluid from the air conditioning system through the low pressure branch and takes the coolant fluid into the coolant tank via ducts, the method comprising:

transferring the coolant fluid from the coolant tank to the air conditioning system through the high pressure branch;

opening the low pressure branch, at least partly simultaneously with, opening of the high pressure branch and maintaining the low pressure branch open during transferring of the coolant fluid to the air conditioning system such that at least part of the transferred coolant fluid can be suctioned away from the air conditioning system;

suctioning away from the air conditioning system through a low pressure valve part of the coolant fluid transferred from the coolant tank to the air conditioning system;

wherein, while the low pressure branch and the high pressure branch are simultaneously open, running the compressor and thereby forcing recovered coolant fluid into the coolant tank and thereby raising or maintaining pressure in the coolant tank sufficient to provide sufficient high pressure in the high pressure branch without having to heat the coolant tank to raise the pressure therein;

wherein an amount of the coolant fluid transferred from the coolant tank to the air conditioning system is higher than an amount of the coolant fluid suctioned away from the air conditioning system through the low pressure valve.

2. The method according to claim 1, wherein part of the coolant fluid transferred from the coolant tank to the air conditioning system is suctioned in the form of vapour so that the net amount of the coolant fluid that enters into the air conditioning system is always positive and more of the coolant fluid is loaded with respect to the suctioned coolant fluid.

3. The method of claim 1, wherein the loading of the coolant fluid in the air conditioning system is completed in the absence of use of a heating bundle for the coolant tank.

4. The method of claim 1, wherein the loading of the coolant fluid is completed with an absence of performing a vacuum phase.

5. The method of claim 1, wherein the loading of the coolant fluid is commenced when the air conditioning system is already partly loaded with coolant fluid.

6. The method of claim 1, wherein the pressure in the low pressure branch is lower than it would be if the low pressure branch was closed.

7. The method of claim 1, wherein, while coolant fluid is being transferred to the air conditioning system, some of said transferred coolant fluid is expanded to vapor phase and is suctioned away from the air conditioning system to the coolant tank.

8. The method of claim 1, wherein the transferring of the coolant fluid to the air conditioning system occurs at a speed comparable to a speed obtained with a loading gear pump.

* * * * *